US008091700B2

(12) United States Patent
Nardozza

(10) Patent No.: US 8,091,700 B2
(45) Date of Patent: Jan. 10, 2012

(54) DUAL USE PAINT BRUSH PACKAGE AND PAINT PALETTE

(75) Inventor: Joe Nardozza, Maywood, NJ (US)

(73) Assignee: Loew-Cornell, LLC, Erlanger, KY (US)

( * ) Notice: Subject to any disclaimer, the term of this patent is extended or adjusted under 35 U.S.C. 154(b) by 458 days.

(21) Appl. No.: 12/368,897

(22) Filed: Feb. 10, 2009

(65) Prior Publication Data

US 2009/0202733 A1 Aug. 13, 2009

Related U.S. Application Data

(60) Provisional application No. 61/027,502, filed on Feb. 11, 2008.

(51) Int. Cl.
*B44D 3/04* (2006.01)

(52) U.S. Cl. ..... 206/1.7; 206/362; 206/470

(58) Field of Classification Search ..... 206/1.7–1.9, 206/362, 470; 312/231; D3/295; D19/35, D19/36

See application file for complete search history.

(56) References Cited

U.S. PATENT DOCUMENTS

| | | | | | |
|---|---|---|---|---|---|
| 924,865 | A | * | 6/1909 | Wilson | 206/1.8 |
| 1,391,028 | A | * | 9/1921 | Werntz | 206/1.8 |
| 1,478,242 | A | * | 12/1923 | Milliken, Jr. | 206/1.8 |
| 2,090,083 | A | * | 8/1937 | Wallace | 206/1.7 |
| 2,221,191 | A | * | 11/1940 | James | 206/1.8 |
| 2,992,501 | A | | 7/1961 | Douglas | |
| 3,089,584 | A | * | 5/1963 | King | 206/1.8 |
| 3,650,589 | A | * | 3/1972 | Linger | 312/231 |
| 3,945,490 | A | | 3/1976 | Thompson | |
| 3,954,314 | A | * | 5/1976 | Crawford | 312/231 |
| 4,423,811 | A | * | 1/1984 | Knapp | 206/470 |
| 4,619,364 | A | * | 10/1986 | Czopor, Jr. | 206/470 |
| 4,765,457 | A | * | 8/1988 | Rayhle | 206/1.8 |
| 5,325,958 | A | * | 7/1994 | Arasim | 206/1.8 |
| 5,498,282 | A | * | 3/1996 | Miller et al. | 524/423 |
| 6,213,778 | B1 | | 4/2001 | Cohen | |
| D443,299 | S | * | 6/2001 | Harrison | D19/36 |
| D600,748 | S | * | 9/2009 | Tabuchi et al. | D19/35 |
| 2007/0235362 | A1 | * | 10/2007 | Lewis | 206/470 |

* cited by examiner

*Primary Examiner* — Bryon Gehman
(74) *Attorney, Agent, or Firm* — Lawrence J. Shurupoff

(57) ABSTRACT

A package for holding and displaying paint brushes includes one or more receptacles for holding paint. Once the paint brushes are removed from the package, empty paint receptacles formed in the cover of the package can be filled with paint and thereby serve as an artist's palette. The package can be reused over and over and thereby reduce trash.

16 Claims, 5 Drawing Sheets

DUAL USE PAINT BRUSH PACKAGE AND PAINT PALETTE

RELATED APPLICATION

This application claims the benefit of U.S. Provisional Application Ser. No. 61/027,502, filed on Feb. 11, 2008, and is incorporated by reference herein in its entirety.

BACKGROUND AND SUMMARY

Artist paint brushes are typically packaged in plastic containers which, once opened, are discarded as trash. It would be desirable to provide such a package which can have an additional function or use after opening so as to be more ecologically friendly or "green" by reducing such trash. In accordance with one embodiment of the disclosure, a paint brush package is constructed with an additional function such that once opened, the package may be used as a palette for holding, providing and/or mixing paint.

IN THE DRAWINGS

In the various views of the drawings, like reference numerals designate like parts.

DESCRIPTION OF A REPRESENTATIVE EMBODIMENT

Figure 1:
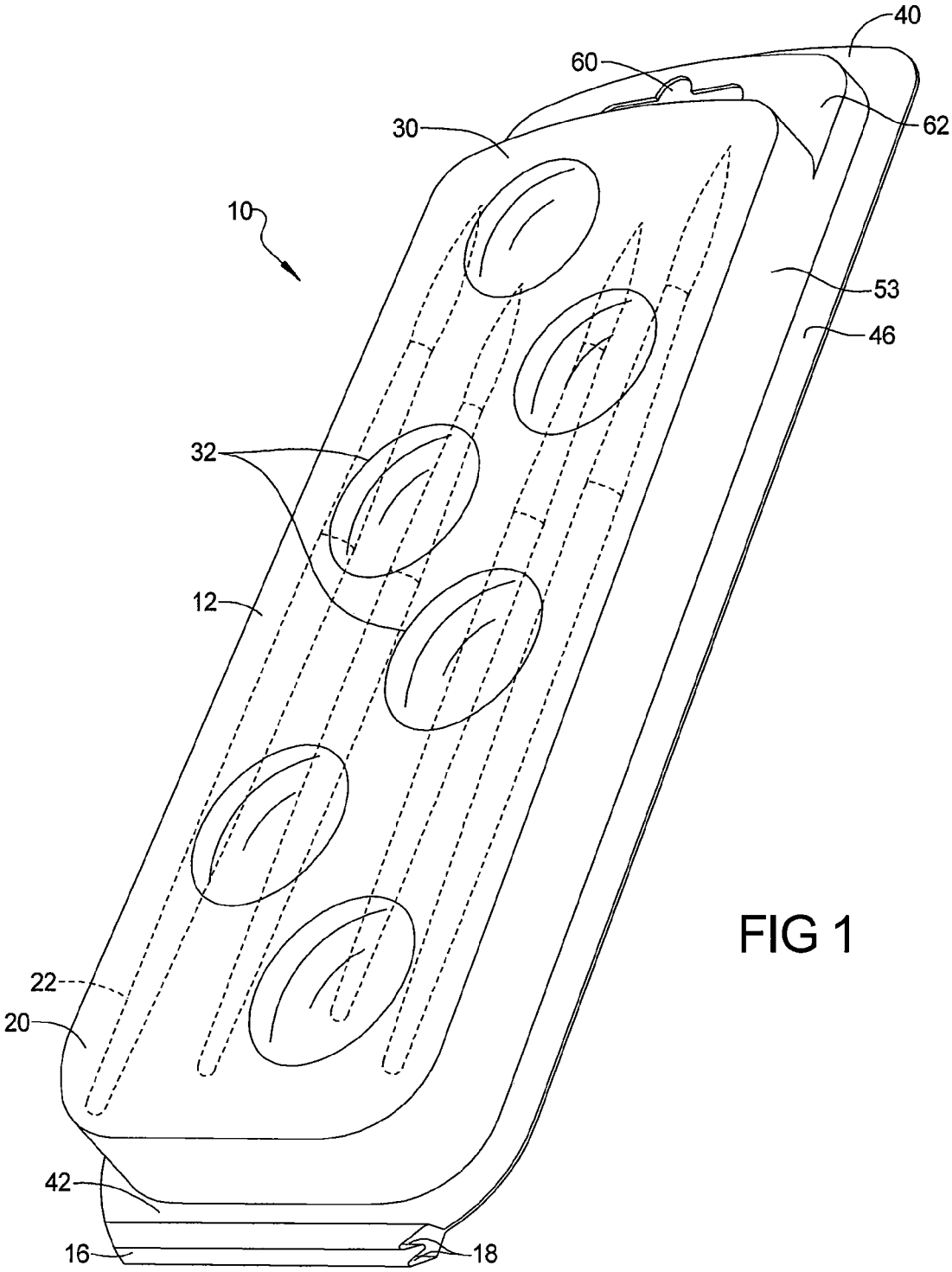
FIG. 1 is a bottom right front perspective view of a representative embodiment of the disclosure showing a paint brush package holding a plurality of paint brushes.

As seen in FIG. 1, a clear transparent paint brush package or holder 10 is formed by a molding, stamping, hot forming or other conventional method. Blow molding is a preferred method. The package is formed with a one-piece, thin-walled clamshell design, although a two piece package can also be used. A first or front cover 12 is pivotally connected to a second or rear cover 14 (FIG. 2) with an integral homogeneously formed living hinge 16. Although hinge 16 is shown located along the bottom of the package 10, it can be located on any peripheral edge of the package.

Figure 2:
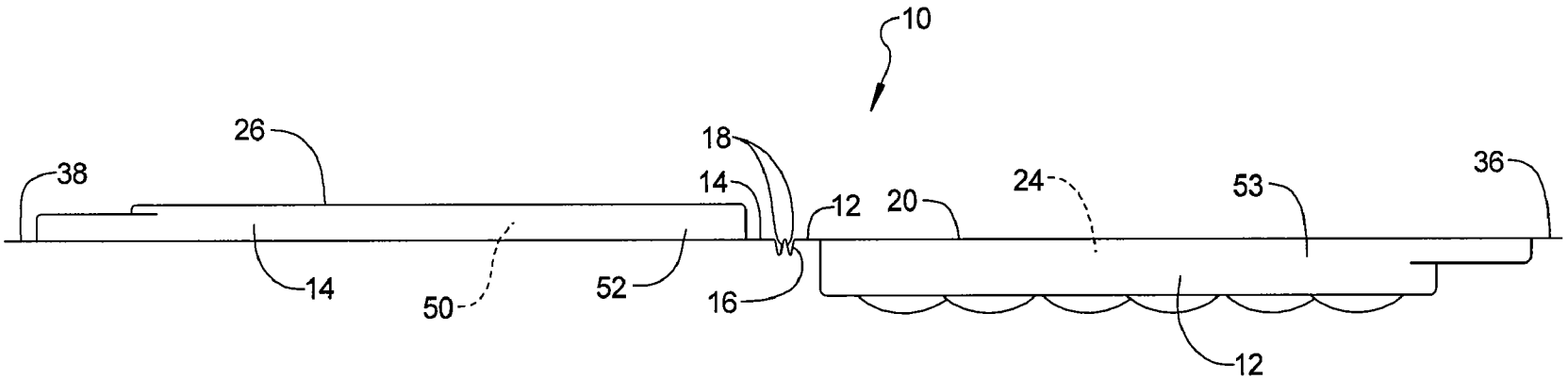
FIG. 2 is a left side view of the package of FIG. 1 in a fully open position.

As seen in FIGS. 1 and 2, the hinge 16 is formed with two parallel channels or troughs 18. One channel 18 is formed on the edge of the front cover 12 and the other channel 18 is formed on the edge of rear cover 14. Together, the channels 18 define a W-shaped cross section which provides greater flexibility to the hinge 16 to allow the front cover 12 to lie flat on a flat support surface when placed in an opened position as shown in FIG. 2.

Figure 3:
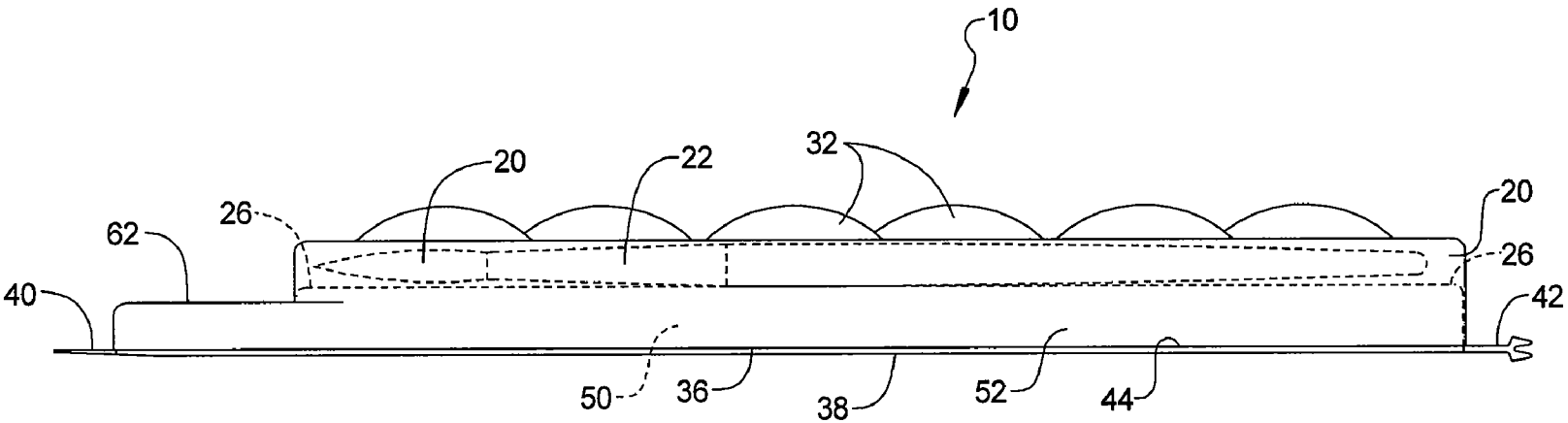
FIG. 3 is a view of the package of FIG. 2 in a fully closed position.

An internal elongated closed compartment 20 (FIGS. 3 and 4) is defined between the front and rear covers 12, 14 for holding one or more paint brushes 22 when the front and rear covers are pressed together as shown in FIG. 1. The pan-shaped front cover 12 is formed with a deep recess 24 which is deeper than the internal compartment 20 formed between the closed covers 12, 14. A complementary platform 26 (FIGS. 2 and 3) formed on the rear cover 14 can be inserted partially into the recess 24 to form a rear wall 28 of the compartment 20 and hold the covers together with a light friction fit.

The front wall 30 of the compartment 20 is formed with one or more paint receptacles 32. The receptacles 32 can be formed as dome-shaped hollow molded projections extending outwardly or forwardly as shown, or rearwardly and inwardly, from the front wall 30 on the front cover 12. The receptacles can be formed as portions of a sphere, or any other suitable cavity shape such as oval, rectangular, or polygonal. As described below, the receptacles can serve as a paint palette.

The front cover 12 and the rear cover 14 each are formed with a peripheral flange 36, 38 (FIG. 2), which when pressed together as shown in FIG. 1, form a two-layered flange having a laminated top edge 40, bottom edge 42, left side edge 44 and right side edge 46. The laminated or overlapping edges 40, 42, 44, and 46 provide strength and rigidity to the paint brush package 10. Both the rear wall 28 and the front wall 30 of compartment 20 are spaced forwardly from the superimposed peripheral flanges to form a rear cavity 50 beneath the platform 26.

A side wall 52 surrounds the cavity 50 and separates and spaces the rear cavity 50 from the peripheral flanges. A sidewall 53 surrounding recess 24 serves as a splash guard to retain paint within the deep recess 24 when a painter is mixing, pouring and removing paint from the paint receptacles 32. The height of side wall 53 is greater than the height of side wall 52 by an amount equal to the height of compartment 20.

As further seen in FIG. 1, the paint receptacles 32 are arranged in a top-to-bottom zig-zag pattern, but can be arranged in any suitable pattern. The zig-zag pattern separates the paint receptacles laterally or transversely across the front wall 30 (between the side edges 44, 46) as well as longitudinally from top to bottom along the front wall 30 (between the top and bottom edges 40, 42). This spacing of the receptacles provides lateral and longitudinal stability to the front cover when it is in an open position as seen in FIG. 2.

Figure 4:
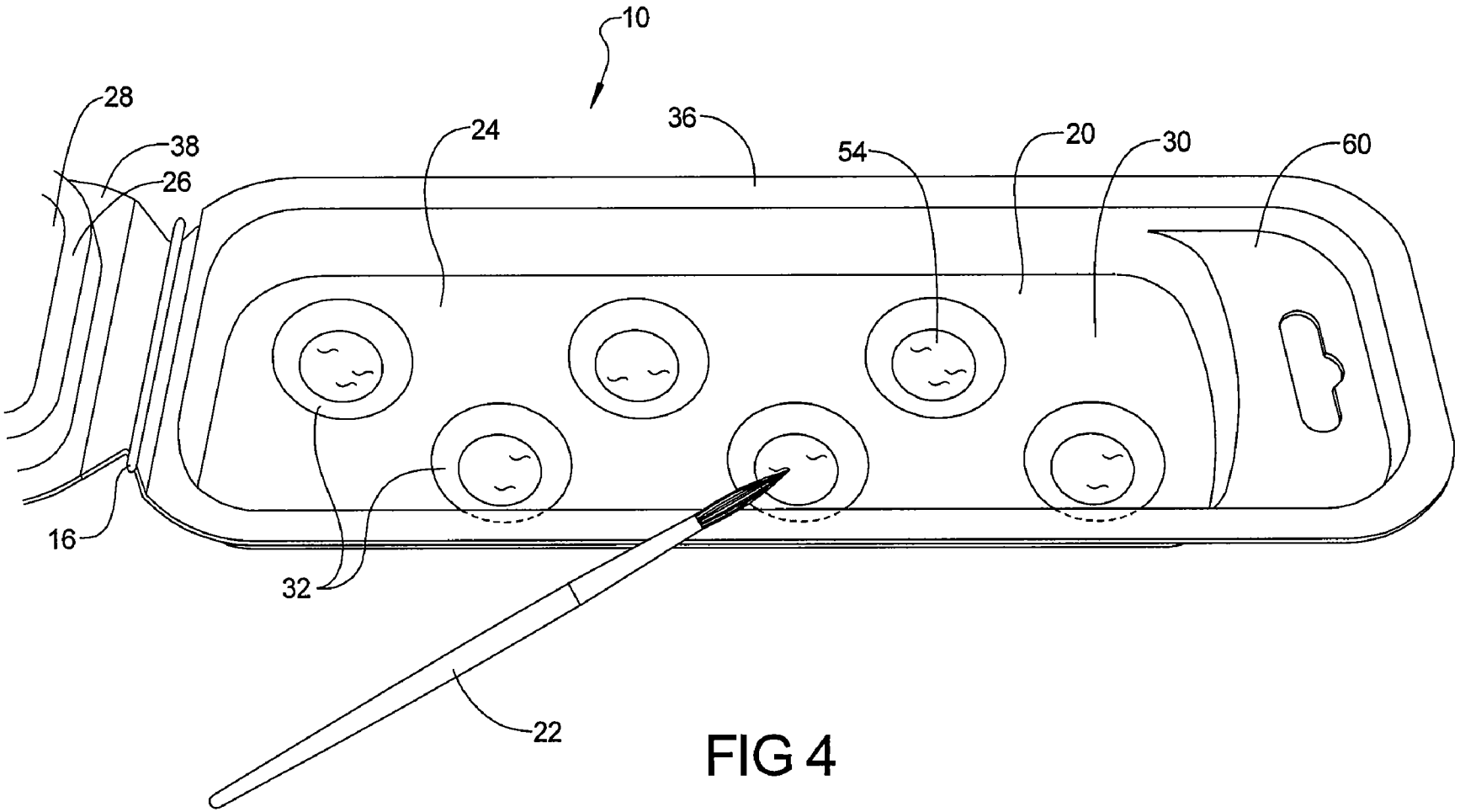
FIG. 4 is a partial top perspective view of the interior of the front cover of the package of FIG. 1 showing a paint brush dipped into paint held in a paint receptacle formed in the package.
Figure 5:
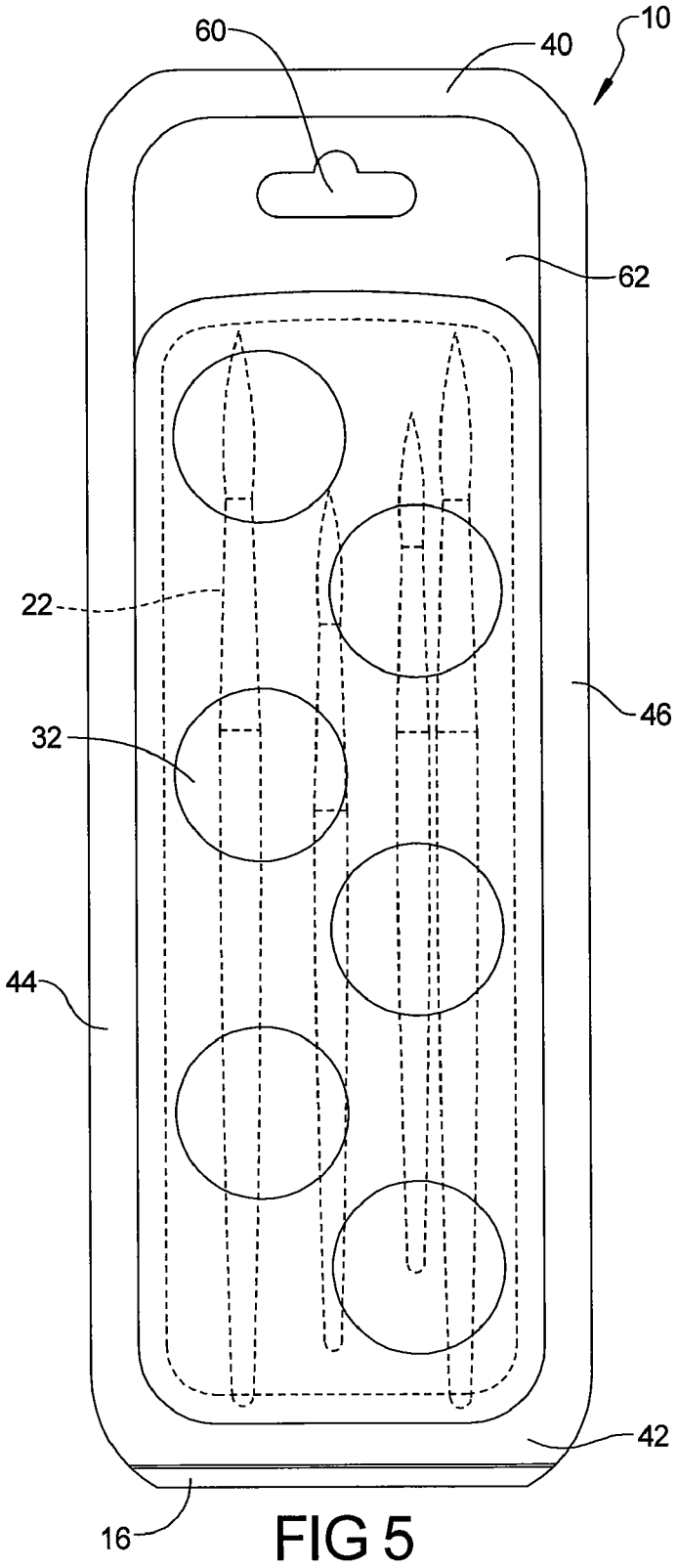
FIG. 5 is a front view of FIG. 1.

The front or outer surfaces of the receptacles 32 act as stabilizing feet for the inverted or prone front cover 12. In this manner, liquid paint 54 as seen in FIG. 4, can be mixed in the receptacles without tipping or spilling. Moreover, this stability prevents spilling of paint when a brush is dipped into one of the receptacles. In one embodiment, the receptacles can be about one and one quarter inch in diameter at their base or intersection along the flat front wall 30 and project upwardly about one quarter inch above the front wall 30.

An opening or aperture 60 is formed in a top portion of the front and rear covers 12, 14 for hanging the package 10 on a hook, hanger or display rack. As seen in FIG. 1, the aperture can be formed in a stepped portion 62 of the package 10 adjacent to the top edge 40.

In use, a painter opens the package 10 by separating the front and rear covers by peeling the peripheral flanges 36,38 apart to gain access to the internal compartment 20. One or more brushes or all of the brushes 22 stored in compartment 20 are then removed from the compartment 20 and the package 10 is then arranged on a support surface as shown in FIG. 2. Paint 54 is then dispensed by a painter or artist into one or more of the paint receptacles 32. Additional paints of various colors can be introduced into the same paint receptacle and mixed therein, and/or additional paint can be dispensed into one or more of the other paint receptacles. A painter then dips a brush 22 into the paint 54 and paints a picture, portrait or other work.

While the paint receptacles 32 are typically empty when the package 10 with enclosed paint brushes 22 are displayed, marketed and sold, it is possible to provide solid or semi-solid paint in the paint receptacles 32 along with the paint brushes so as to provide a paint and paint brush set.

It will be appreciated by those skilled in the art that the above paint palettes are merely representative of the many possible embodiments of the invention and that the scope of the invention should not be limited thereto, but instead should only be limited according to the following claims.

What is claimed:

1. A paint brush package holding and displaying paint brushes and serving as a paint palette, comprising:

a first cover having a front wall;

a second cover connected to said first cover so as to form a compartment for holding said paint brushes;

said covers including suspension means to suspend the package so that said front wall will hang in a substantially vertical disposition;

said plurality paint brushes held in said compartment between said first and second covers and maintained substantially vertical lengthwise when suspended by said suspension means;

a plurality of empty paint receptacle defining a paint palette formed in said first cover, said plurality of empty paint receptacles projecting away from said front wall; and said first cover and said plurality of empty paint receptacles formed from a clear transparent material and displaying said plurality of paint brushes within said compartment.

2. The package of claim 1, wherein said first and second covers are connected by a hinge and wherein said first and second covers, said hinge and said plurality of paint receptacles are formed as a one-piece plastic package.

3. The package of claim 2, wherein said hinge is formed as a pair of parallel channels.

4. The package of claim 1, wherein said package has a top edge, a bottom edge and two side edges, and wherein a hinge is formed on one of said edges.

5. The package of claim 1, wherein said plurality of paint receptacles comprises a plurality of dome-shaped receptacles.

6. The package of claim 1, wherein said first and second covers define a closed, layered top portion having a mounting aperture formed therethrough defining said suspension means.

7. The package of claim 1, wherein said first and second covers define a closed, layered peripheral flange and said second cover defines a cavity surrounded by said flange.

8. The package of claim 7, wherein said second cover comprises a rear wall, and wherein said front wall and said rear wall are each spaced apart forwardly from said peripheral flange.

9. The package of claim 8, wherein said front wall and said rear wall are spaced apart to form said compartment holding said plurality of paint brushes.

10. The package of claim 1, wherein said first cover defines a side wall surrounding said plurality of paint brushes.

11. A method of using a paint brush package as a display for a paint brush and as a paint palette, wherein said method comprises:

packaging at least one paint brush in a transparent plastic package having a living hinge and at least one empty transparent paint receptacle formed in and projecting away from a front wall of the package said package including suspension means to suspend the package so that said front wall will hang in a substantially vertical disposition;

displaying the at least one paint brush within the transparent plastic package with the paint brush maintained substantially vertical lengthwise when suspended by said suspension means;

removing the at least one paint brush from the transparent plastic package;

filling the at least one empty transparent paint receptacle projecting away from the wall of the package with paint to form a paint filled receptacle; and using the paint filled in the at least one paint filled receptacle to paint with the at least one paint brush.

12. A package for holding and displaying paint brushes and for serving as an artist's paint palette, comprising:

a first transparent plastic cover connected to a second cover so as to define a compartment therebetween;

said cover including suspension means to suspend the package so that a front wall of said first cover will hang in a substantially vertical disposition;

a paint brush held within said compartment and maintained substantially vertical lengthwise when suspended by said suspension means; and a plurality of empty paint receptacles formed in and projecting away from said front wall of said first cover so as to define said artist's palette and display said paint brush within said compartment through said plurality of empty paint receptacles.

13. The package of claim 12, wherein said plurality of empty paint receptacles project outwardly away form said compartment.

14. The package of claim 13, wherein said plurality of empty paint receptacles project inwardly into said compartment.

15. The package of claim 12, wherein said first and second covers are connected with a friction fit.

16. The package of claim 12, wherein said first and second covers are interengaged with a platform inserted into a recess with a friction fit so as to define said compartment.

* * * * *